US007685924B2

(12) United States Patent
Barbe et al.

(10) Patent No.: US 7,685,924 B2
(45) Date of Patent: Mar. 30, 2010

(54) PROTECTION DEVICE FOR THE FLOOR OF A LAND VEHICLE

(75) Inventors: Yves Barbe, Bois d'Arcy (FR); Benoît Bettencourt, Chaville (FR); Laurent Wagnez, Bourges (FR)

(73) Assignee: Nexter Systems, Roanne Cedex (FR)

( * ) Notice: Subject to any disclaimer, the term of this patent is extended or adjusted under 35 U.S.C. 154(b) by 367 days.

(21) Appl. No.: 11/705,741

(22) Filed: Feb. 14, 2007

(65) Prior Publication Data

US 2008/0034953 A1 Feb. 14, 2008

(30) Foreign Application Priority Data

Feb. 17, 2006 (FR) ..... 06 01526

(51) Int. Cl.
*F41H 5/14* (2006.01)

(52) U.S. Cl. ..... 89/36.09

(58) Field of Classification Search ..... 89/36.09
See application file for complete search history.

(56) References Cited

U.S. PATENT DOCUMENTS

| | | | | |
|---|---|---|---|---|
| 4,280,393 | A * | 7/1981 | Giraud et al. | 89/36.08 |
| 5,533,781 | A * | 7/1996 | Williams | 296/204 |
| 5,866,839 | A * | 2/1999 | Ohayon | 89/36.08 |
| 6,477,934 | B1 * | 11/2002 | Bruhn et al. | 89/36.08 |
| 6,658,984 | B2 * | 12/2003 | Zonak | 89/36.08 |
| 6,779,431 | B2 * | 8/2004 | Honlinger | 89/36.08 |
| 7,228,927 | B2 * | 6/2007 | Hass et al. | 180/65.25 |
| 7,255,034 | B2 * | 8/2007 | Strassgurtl et al. | 89/36.08 |
| 2003/0010189 | A1 * | 1/2003 | Zonak | 89/36.08 |
| 2007/0084337 | A1 * | 4/2007 | Strassgurtl et al. | 89/36.08 |

FOREIGN PATENT DOCUMENTS

| | | | |
|---|---|---|---|
| DE | 101 44 208 | A1 | 3/2003 |
| DE | 203 15 057 | U1 | 3/2005 |
| EP | 1 081 452 | A2 | 3/2001 |
| EP | 1 182 420 | A1 | 2/2002 |
| EP | 1 574 812 | A1 | 9/2005 |
| WO | WO 03/102489 | A1 | 12/2003 |
| WO | WO 2004/038320 | A1 | 5/2004 |

* cited by examiner

*Primary Examiner*—Troy Chambers
(74) *Attorney, Agent, or Firm*—Oliff & Berridge, PLC

(57) ABSTRACT

A protection device for the floor of a land vehicle against mines, said device comprising at least one caisson with a convex external surface oriented towards the ground wherein said caisson incorporates a median part arranged between two lateral walls and extending over the full length of said caisson, the median part of said caisson being of a thickness (E) greater than that (e) of said lateral walls and being designed so as to transmit the stress, when a mine detonates, towards said lateral walls.

11 Claims, 3 Drawing Sheets

PROTECTION DEVICE FOR THE FLOOR OF A LAND VEHICLE

BACKGROUND OF THE INVENTION

1. Field of the Invention

The technical scope of the invention is that of devices to ensure the protection of the floor of a land vehicle against mines.

2. Description of the Related Art

To protect the floor of a land vehicle it is known to position armor under the floor so as to absorb and/or deviate the blast produced by the mine. Know armor comprises one or several metallic or composite layers and possibly deflector means.

Patent DE10144208 thus describes armor incorporating a convex caisson covering the vehicle floor. The shape of the caisson ensures the deviation of part of the mine's blast.

These known types of armor or protection devices are usually of constant thickness over the full width to be protected and are defined according to the maximal constraints generated by the mine. This results in a considerable mass for the armor which prejudices the vehicle's mobility. It also results in reduced ground clearance.

A device to protect a vehicle floor is known by patent WO03/102489 which comprises different elements fixed by bolts (two longitudinal beams, transversal beams, oblique lateral beams, and armor plates). In such a device there are several armor plates fastened to the beams and covering specific zones of reduced dimension. The architecture is not optimized with regard to the transmission of stresses.

SUMMARY OF THE INVENTION

The aim of the, invention is to propose a protection device to ensure, with a relatively reduced overall mass, effective protection for the floors or lower parts of vehicles against the effects of mines, and namely blast-effect mines.

Thus, the invention relates to a protection device for the floor of a land vehicle against mines, such device comprising at least one caisson with a convex external surface oriented groundwards and wherein this caisson incorporates a median part arranged between two lateral walls and extending over the full length of the caisson, the median part being of a thickness greater than that of the lateral walls and being designed so as to transmit the stress, when a mine detonates, towards the lateral walls.

According to a particular embodiment, the median part may be formed by a separate median part which will be made integral with the lateral walls by fastening means.

The median part may be in contact with the lateral walls by bearing surfaces.

The median part may incorporate at least one internal cavity.

According to another embodiment, the median part and the lateral walls may constitute a single-piece assembly.

In all the embodiments, the caisson may have at least one internal partition.

The caisson may also enclose at least one block of shock-absorbing material.

According to one embodiment of the invention, the caisson may constitute an element added onto a vehicle.

According to another embodiment, the caisson may itself constitute part of the very structure of a lower part of a vehicle.

BRIEF DESCRIPTION OF THE DRAWINGS

The invention will become more apparent from the following description of different embodiments, such description being made with reference to the appended drawings, in which.

DETAILED DESCRIPTION OF PREFERRED EMBODIMENTS

Figure 1A:
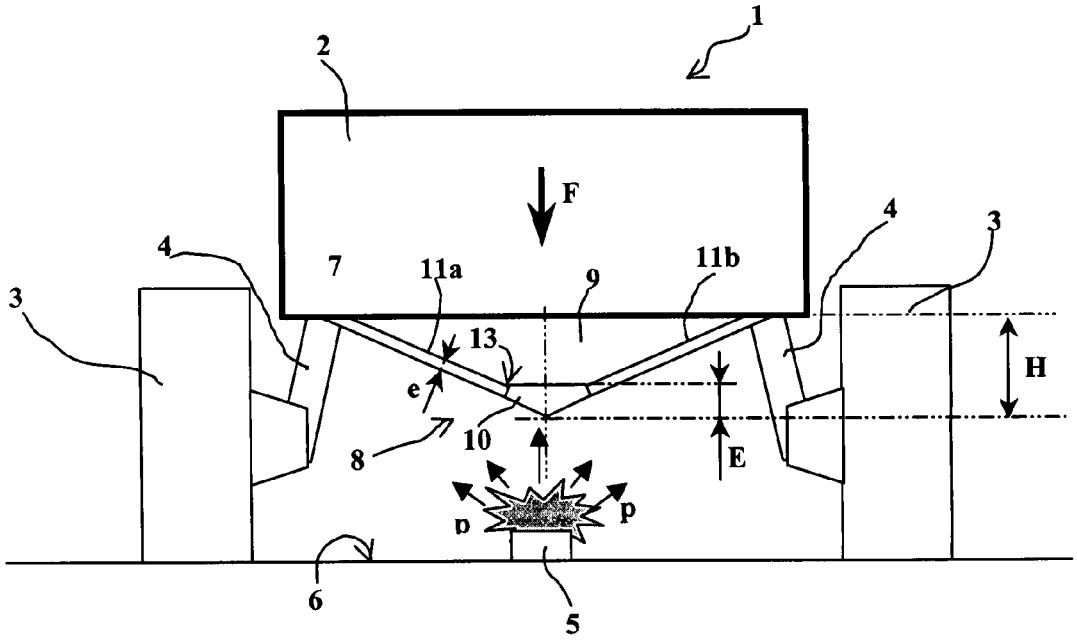
FIG. 1*a* schematically shows a vehicle passing over a mine, such vehicle equipped with a floor protection device according to the invention.

FIG. 1*a* shows a vehicle 1 which incorporates a cab 2 carried by wheels 3 connected to the cab by axle arms 4. FIG. 1*a* shows a blast effect mine positioned on the ground 6. When ignited, this mine generates high pressure (schematized by arrows P) in the direction of the floor 7 of a vehicle 1.

In accordance with the invention, a device 8 is provided to ensure the protection of the floor 7 (or lower part) of the vehicle.

The device is shown here in the form of a separate caisson fastened to the lower part of the vehicle 1.

It is naturally possible, without departing from the scope of the invention, to define a vehicle whose actual structure will incorporate the device 8 incorporated with the cab 2 from the onset. The caisson 8 may thus be incorporated with the floor itself.

The caisson 8, within the meaning of the invention, is intended as a structure delimited by walls and which itself delimits an internal volume 9. This structure may be added onto an existing vehicle to make an over-protection. It may also be designed, from the onset, into the vehicle as a constitutive part of a vehicle cab or floor.

In accordance with the invention, the caisson 8 has a convex external surface oriented groundwards 6.

This caisson furthermore incorporates a median part 10 arranged between two lateral walls 11*a*, 11*b*.

This median part has a thickness E which is greater than the thicknesses e of the lateral walls 11*a* and 11*b*.

The lateral walls 11*a* and 11*b* are thus constituted by sheet metal (for example, sheet steel) whereas the median part is formed here by a part 10 (for example, of steel), obtained by machining or casting, and which is made integral with the lateral walls 11*a*, 11*b* by fastening means, for example, welding.

Figure 2:
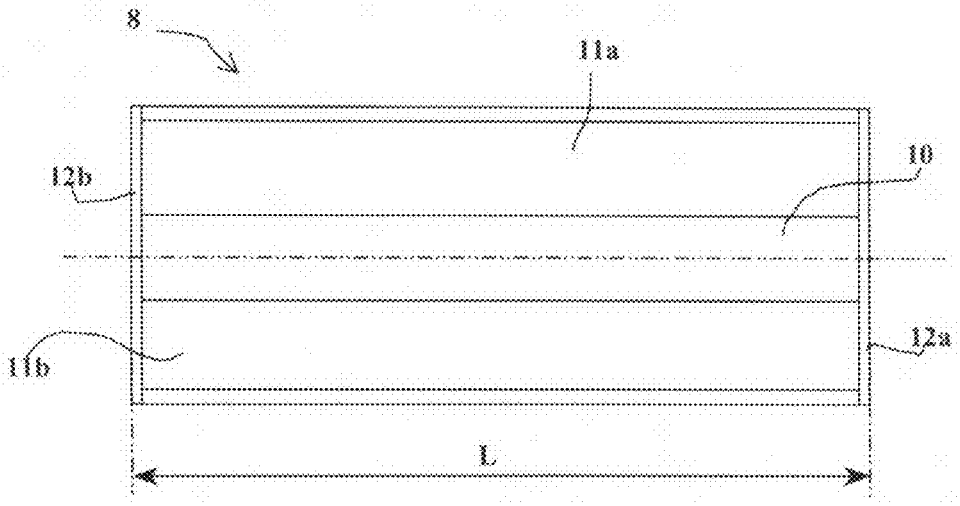
FIG. 2 shows a top view (following arrow F marked in FIG. 1) of a first embodiment of a protection device according to the invention, FIGS. 3 and 4 also show a top view of two other embodiments of the device according to the invention.

As may be more particularly seen in FIG. 2, which is a top view of the caisson following arrow F marked in FIG. 1*a*, the part 10 extends over the full length L of the caisson 8.

Moreover, the caisson 8 is delimited at its front and rear faces by steel closing plates 12*a* and 12*b*, welded to walls 11*a* and 11*b*. To make the device lighter, it is naturally possible not to provide closing plates 12*a*, 12*b* (namely when the caisson is an add-on protection).

Part 10 will preferably be linked to walls 11*a*, 11*b* by bearing surfaces 13 which will be inclined with respect to the vertical (see FIG. 1*a*).

The caisson 8 will be given a length L equal to that of the part of the vehicle which is to be protected first and foremost. It is possible for the caisson 8 to be of a total length equal to the length of the vehicle 1.

By proposing to give the caisson 8 a thickness at its median part E which is greater than that of its lateral walls 11*a*, 11*b*, the resistance of the caisson is improved and the caisson is made lighter. Indeed, the lateral walls are further from the ground than the median part and they are inclined. It is thus possible for them to be made lighter with respect to the median part.

The caisson according to the invention behaves in a totally different manner to that of known convex caissons during the detonation of a mine.

Known caissons deviate part of the mine's blast thanks to their convexity, but they must be sufficiently resistant mechanically to avoid the sheet metal making up the caisson tearing. This results in caissons which are thick and heavy.

The caisson according to the invention incorporates a solid median part 10 resistant to tearing which transmits part of the shock received to the lateral walls. This transmission is made via the bearing surfaces 13 linking the lateral parts to part 10.

If part of the blast is deviated by the convex form, the main stress, received vertically at part 10, is transmitted to walls 11*a*, 11*b* causing them to deform and causing the caisson 8 to gradually flatten towards the floor 7.

This mechanical deformation has slower kinematics than that of caissons with even thickness. It enables the energy communicated by the mine to be consumed and thereby protects the floor.

The lateral walls 11*a* and 11*b* may thus be thinner since they are located at a distance from the median part which is the part most stressed by the mine's effects.

The bearing surfaces 13 shown in FIG. 1*a* are plane surfaces substantially perpendicular to lateral walls 11*a* and 11*b*.

It is naturally possible for the bearing surfaces to be given another shape or orientation to make it easier to attach part 10 by welding and to transmit the stresses.

Figure 1B:
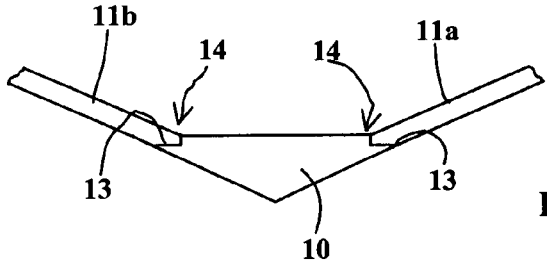
FIG. 1*b* is a detailed view of an embodiment of the bearing surfaces.

FIG. 1*b* thus shows substantially horizontal bearing surfaces 13 which are formed by grooves 14 arranged on each side of part 10 onto which the beveled ends of the lateral walls 11*a*, 11*b* are applied.

Someone skilled in the art will dimension the lateral walls 11*a*, 11*b* and part 10 according to the characteristics of the mine threat against which protection is sought for the vehicle as well as to the characteristics of the vehicle itself.

It is thus possible to make caissons 8 whose height H is lower than that of known blast deviation caissons. The vehicle's ground clearance is thus improved.

For an equivalent protection capacity, the surface density of the caisson may thus be reduced with respect to that of known caissons of even thickness. This results in protection's reduced overall mass.

A caisson 8 has been described which associates steel lateral walls 11*a*, 11*b* which a median part 10 also made of steel. It is naturally possible to implement different materials. A caisson 8 may thus be made of a magnetic materials, such as aluminum for example, aluminum alloys or titanium. The caisson 8 may also be made partly of composite materials. These solutions enable the caisson to be further lightened and its magnetic signature reduced.

The internal volume 9 of the caisson 8 may house the mechanical organs of the vehicle, for example the drive shaft.

The external form of part 10 may also be different from a triangular shape. A part 10 may be adopted whose external profile is rounded, for example cylindrical or hyperbolic.

It is also possible for a caisson to be made as a single piece whose median part 10 is made in one piece with the lateral walls 11*a*, 11*b*. The caisson 8 will in this case be a single piece obtained, for example, by casting or machining.

Figure 3:
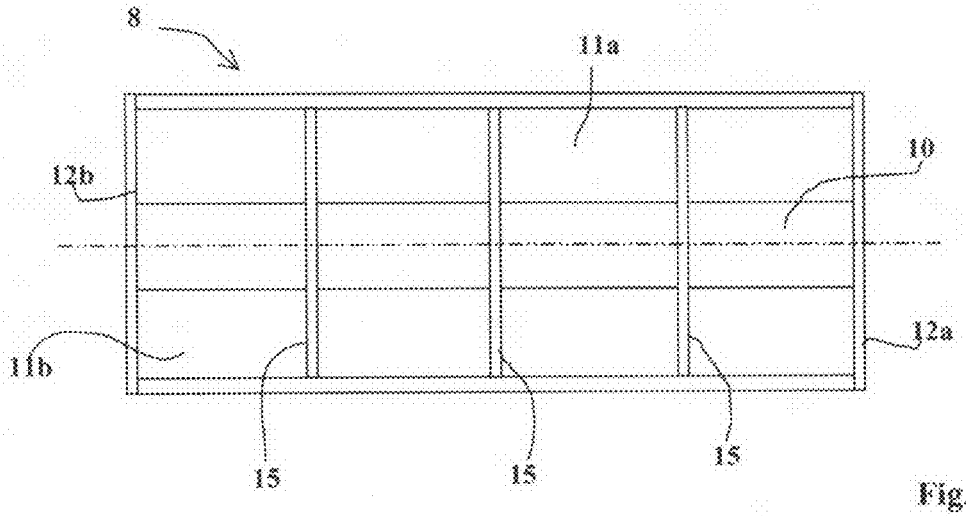

FIG. 3 shows another embodiment of the invention in which the caisson 8 incorporates internal partitions 15 enabling it to be made more rigid. These partitions have an analogous profile to that of the closing plates 12*a*, 12*b* and press both on the lateral walls 11*a*, 11*b* and on part 10.

The partitions 15 will be made, for example, in the form of sheets of metal welded to walls 11*a*, 11*b*. Such an embodiment enables different deformation zones for the caisson's structure to be delimited between each pair of partitions.

Figure 4:
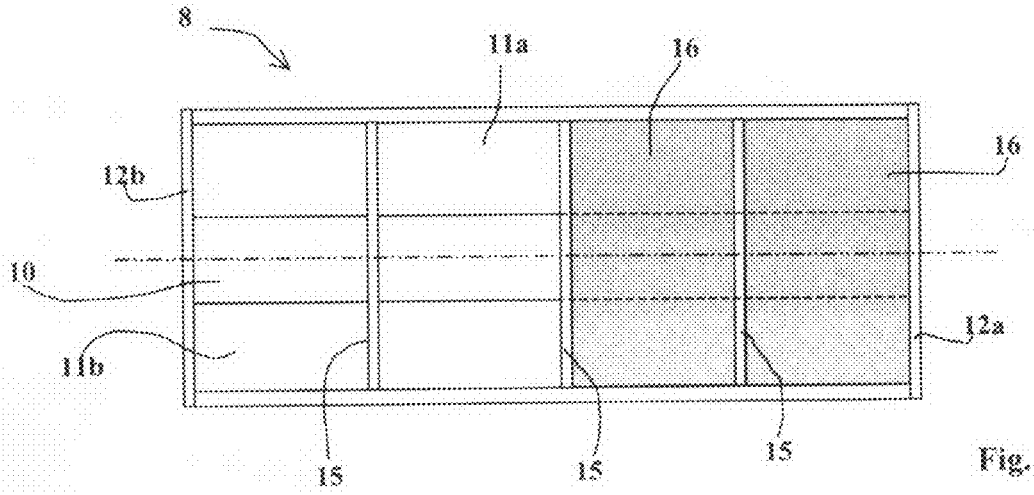

So as to further improve the level of protection, it is possible, as shown in FIG. 4, to place one or several blocks 16 of a compressible material between two partitions 15. The blocks may be made, for example, of a cellular material (such as a honeycomb). The blocks may be of a metallic material, or else an organic or composite one.

It is naturally possible for one or several blocks 16 to be provided for a caisson which does not have any partitions 15 (such as the caisson shown in FIG. 2). In this case, the block or blocks 16 will be fixed to the caisson 8, for example by bonding onto the lateral walls 11*a*, 11*b*.

FIG. 4 shows two blocks 16 arranged at a front part of the caisson 8. The two housings delimited by the partitions 15 to the rear of the caisson 8 have no blocks. It is thus possible to provide shock-absorbing blocks 16 only for a zone of the caisson 8 which requires particular reinforcement.

Figure 5A:
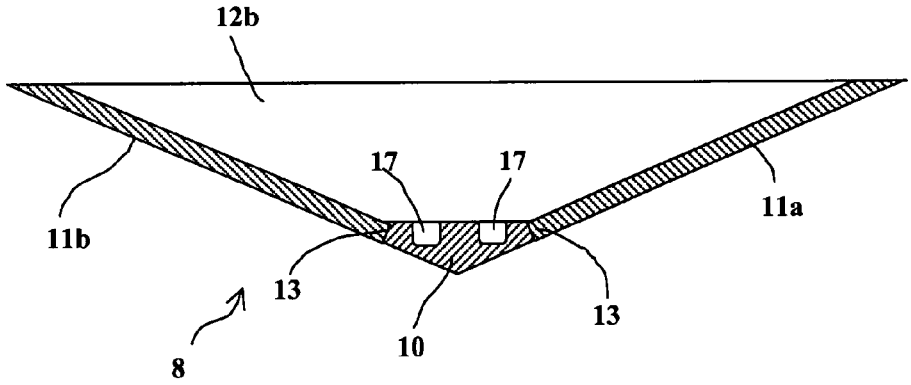
FIGS. 5*a* and 5*b* show another embodiment of the invention, FIG. 5*b* being a top view and FIG. 5*a* being a cross section, such section being made along plane AA marked in FIG. 5*a*.
Figure 5B:
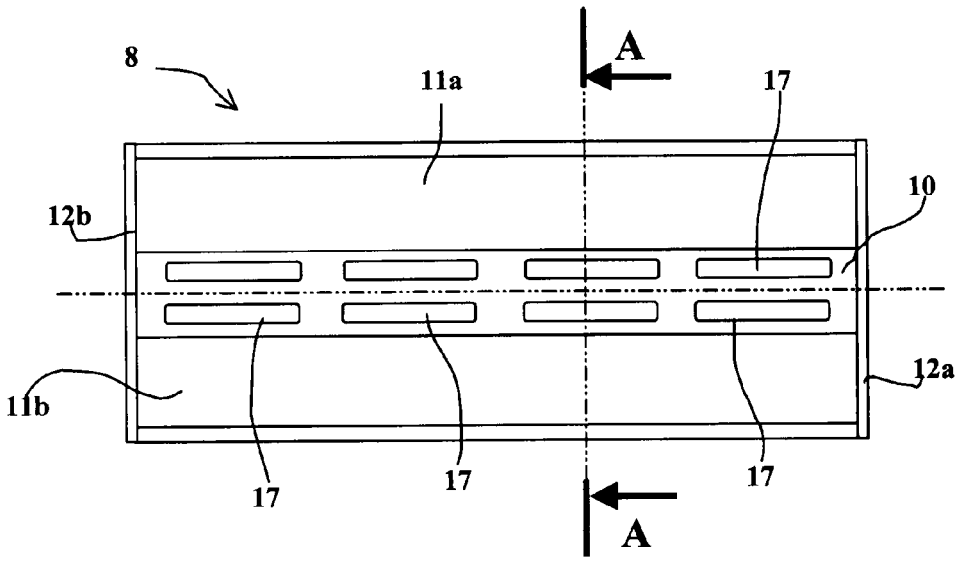

FIGS. 5*a* and 5*b* show another embodiment of the invention in which the caisson 8 incorporates a lightened median part 10. This part 10 thus incorporates cavities 17 evenly spaced over its length.

These cavities enable the mass of the part to be reduced without reducing its rigidity at the same time.

Someone skilled in the art will easily dimension the number, shape, dimensions and spacing of the cavities 17 in part 10 according to the rigidity properties required.

The cavities 17 may be made by machining or else obtained by casting during the manufacture of part 10.

It is naturally possible to combine the different embodiment described previously according to operational requirements.

A caisson may be defined according to FIGS. 5*a*, 5*b* which also incorporates partitions 15 and/or blocks 16.

In this case, the shape of the bearing surfaces 13 may be chosen like those shown in FIG. 1*b*.

Finally, longitudinal partitions may be provided in the volume 9 of the caisson that are perpendicular to transversal partitions 15. An internal mesh will thus be made inside which the blocks of shock-absorbing material may be arranged.

What is claimed is:

1. A protection device for a floor of a land vehicle against mines, said device comprising at least one caisson with a convex external surface oriented towards the ground wherein said caisson incorporates a median part arranged between two lateral walls and extending over a full length of said caisson, the median part of said caisson being of a thickness (E) greater than that (e) of said two lateral walls and being designed so as to transmit a stress, when a mine detonates, towards said two lateral walls, wherein the median part forms an apex and a line of symmetry, and the line of symmetry passes through the apex.

2. A floor protection device according to claim 1, wherein said median part is formed by a separate median part which is made integral with said two lateral walls by fastening means.

3. A floor protection device according to claim 2, wherein said median part is in contact with said two lateral walls by bearing surfaces.

4. A floor protection device according to claim 2, wherein said median part incorporates at least one internal cavity.

5. A floor protection device according to claim 3, wherein said median part incorporates at least one internal cavity.

6. A floor protection device according to claim 1, wherein said median part and said two lateral walls constitute a single-piece assembly.

7. A floor protection device according to claim 1, wherein said caisson has at least one internal partition.

8. A floor protection device according to claim 1, wherein said caisson encloses at least one block of shock-absorbing material.

9. A floor protection device according to claim 6, wherein said caisson encloses at least one block of shock-absorbing material.

10. A floor protection device according to claim 1, wherein said caisson constitutes an element added onto said land vehicle.

11. A floor protection device according to claim 1, wherein said caisson constitutes a part of a structure of a lower part of land vehicle.

* * * * *